US006520246B2

(12) United States Patent
Poloni et al.

(10) Patent No.: US 6,520,246 B2
(45) Date of Patent: Feb. 18, 2003

(54) METHOD AND DEVICE FOR CONTINUOUS CASTING OF MOLTEN MATERIALS

(75) Inventors: Alfredo Poloni, Fogliano Redipuglia (IT); Milorad Pavlicevic, Udine (IT); Anatoly Kolesnichenko, Kiev (UA); Andrea Codutti, Udine (IT)

(73) Assignee: Danieli & C. Officine Meccaniche S.p.A., Buttrio (IT)

( * ) Notice: Subject to any disclaimer, the term of this patent is extended or adjusted under 35 U.S.C. 154(b) by 25 days.

(21) Appl. No.: 09/783,465

(22) Filed: Feb. 14, 2001

(65) Prior Publication Data

US 2002/0038697 A1 Apr. 4, 2002

(30) Foreign Application Priority Data

Feb. 25, 2000 (IT) ..... MI00A0361

(51) Int. Cl.[7] ..... B22D 27/02; B22D 11/04; B22D 11/07

(52) U.S. Cl. ..... 164/467; 164/502; 164/478; 164/498; 164/416; 164/147.1; 164/268; 164/472

(58) Field of Search ..... 164/467, 502, 164/478, 498, 416, 147.1, 268, 472

(56) References Cited

U.S. PATENT DOCUMENTS

| | | | | |
|---|---|---|---|---|
| 4,130,423 A | | 12/1978 | Chastant et al. | 75/257 |
| 4,353,408 A | | 10/1982 | Pryor | 164/503 |
| 4,460,409 A | * | 7/1984 | Devalois et al. | 75/96 |
| 4,773,469 A | | 9/1988 | Gupta et al. | 164/459 |
| 5,027,887 A | | 7/1991 | Bakshi et al. | 164/472 |
| 5,045,276 A | | 9/1991 | Kijima | 419/9 |
| 5,379,828 A | | 1/1995 | Blazek et al. | 164/459 |
| 5,494,095 A | | 2/1996 | Blazek et al. | 164/418 |
| 5,513,692 A | | 5/1996 | Gerber | 164/467 |
| 5,622,218 A | * | 4/1997 | Pedroza-Contreras | 164/459 |
| 6,003,590 A | * | 12/1999 | Pavlicevic et al. | 164/468 |

FOREIGN PATENT DOCUMENTS

| | | |
|---|---|---|
| JP | 1-284469 | * 11/1989 |
| JP | 10-328785 | * 12/1998 |

OTHER PUBLICATIONS

EPO Office Letter/Search Report Jul. 21, 2000.

* cited by examiner

*Primary Examiner*—Tom Dunn
*Assistant Examiner*—I.-H. Lin
(74) *Attorney, Agent, or Firm*—Abelman, Frayne & Schwab

(57) ABSTRACT

Device and corresponding method for the continuous casting of molten materials, comprising a vertical duct having the shape of a funnel made of refractory material for receiving molten material, and a second duct where the molten material is cooled off, the two ducts being set one on top of the other and being axially aligned. The molten material is injected into the channel, around a stretch of which electromagnetic means are set for generating magnetic forces on the molten material, the said means consisting of a plurality of windings of electrically conductive material and of a ferromagnetic core and may be electrically supplied to produce a magnetic flux along the direction of the channel, thus producing a set of forces acting on the molten material which are directed orthogonally with respect to the direction of the said magnetic flux so as to maintain detachment of the outer surface of the molten material from the walls of the channel.

13 Claims, 4 Drawing Sheets

METHOD AND DEVICE FOR CONTINUOUS CASTING OF MOLTEN MATERIALS

FIELD OF THE INVENTION

The present invention refers to a method for the continuous casting of molten materials, and to the corresponding device for carrying out the said method, in particular usable in plants for the continuous casting of billets, blooms, slabs and the like, to improve the surface and internal quality of the cast product.

STATE OF THE ART

Continuous casting is a technique which is today extensively used in the production of metallic bodies having various shapes and sizes, such as blooms, slabs, billets, and the like. The aim is to achieve increasingly high speeds of vertical casting, which, however, leads to the accentuation of certain problems, such as the difficulty of obtaining a uniform distribution of the speeds throughout the cross section of the product being cast. In addition, the use of a discharging device immersed in the molten material does not facilitate the attainment of a uniform distribution of the said speeds on account of the turbulence caused in the metallic mass.

These elements may give rise to certain phenomena that damage the surface and internal quality of the finished products. Among other things, it is possible to cite as an example the lack of uniformity in the flow of liquid metal in the crystallizer, with consequent non-uniform solidification and possible tearing of the shell being formed. This danger is more accentuated, in particular, in the case of high rates of casting, at which the said shell is formed with a smaller thickness and/or a larger number of cracks is present on the surface or within the cast product, thus possibly causing disastrous leakage of liquid metal from the solidified shell of the ingot.

Another unfavourable phenomenon that may occur regards disturbances of the stability of the meniscus which may cause poor lateral lubrication and leads to the solidifying metal sticking to certain points of the crystallizer, so increasing the risk of tearing of the shell and the production of defects on its surface.

Another problem that may arise in this type of plant is linked to the longitudinal oscillation of the crystallizer, which is necessary to prevent the solidifying metal from sticking to the walls of the inner duct of the crystallizer and to facilitate flow of particular lubricants in the gap between the crystallizer and the solidifying shell. However, this oscillation may, in the presence of a disturbed meniscus, bring about deep and irregular markings on the surface of the shell of the cast product. The drawbacks listed above are of considerable importance both for the final quality of the cast product obtained and for the optimization of the production achievable from the casting system and for the cost of the subsequent transformation of the finished products.

In fact, to verify the defectiveness of the billets, blooms, slabs or similar cast pieces it is necessary to inspect them and possibly subject them to additional surface-conditioning treatments, this resulting in an increase in production costs and/or in a poorer quality of the end product.

Numerous solutions have been proposed in the past to overcome such problems. For example, particular covering powders are used for limiting oxidation of the molten bath and for lubricating the interface between the solidifying metal and the walls of the crystallizer in a more stable way, with consequent positive effects on the surface and internal quality of the cast product.

Another known solution consists of using particular discharging devices, set between the tundish and the crystallizer, whereby it is possible to control the flow of the liquid metal entering the crystallizer, so as to reduce the non-metallic inclusions in the cast product, at the same time favouring flotation of gases on the surface. In this way, there is a reduction in the disturbance of the meniscus, where the initial solidification occurs, and direct "hot" flows of molten metal are avoided, which could lead to the partial re-melting of some areas of the shell that is forming. Attempts to improve the fluid-dynamic conditions in the crystallizer regard the use of particular "ducts or tanks" made of refractory material and set immediately upstream of the crystallizer with the purpose of removing the meniscus of the liquid metal from the area of start of solidification, thus limiting the possibility of drawing particles of refractory material or dross into the solidifying metal, and favouring uniformity of the rate of flow of the metal and of heat exchange between the cast product and the crystallizer, especially in the area of initial solidification, which normally takes place in the area of joining between the refractory material of the walls of the "tank" and the contiguous edge of the cooled metal crystallizer, referred to as "triple point".

The situation in this area proves very delicate because the molten metal tends to adhere to the refractory material, which is colder on account of the vicinity of the copper cooled by forced circulation. Consequently, in this area surface defects or failures arise in the bodies produced.

To overcome such a problem, from the U.S. Pat. Nos. 5,027,887, 5,045,276, and 4,130,423 it is known that gases may be used, such as nitrogen or argon, or solid lubricants, which are injected at the said joint to form a protective layer. However, in this type of solution, the liquid metal, which is considerably heavier than the lubricant and the gas, frequently manages to tear the protective layer and to come into contact even so with the walls of the "tank", which are made of refractory material.

The U.S. Pat. Nos. 5,494,095 and 5,379,828 propose the solution of setting, between the "tank" made of refractory material and the crystallizer, an insert consisting of a material having a thermal and electrical conductivity lower than that of the material of which the crystallizer is built, so that the molten metal will start to solidify at the insert itself. The joint between the insert and the refractory material of the tank is heated by means of an alternating electromagnetic field.

A similar solution, but without heating of the joint between the refractory material and the intermediate insert is proposed by the U.S. Pat. No. 4,773,469.

In continuous casting, in particular of in the casting of thin slabs (i.e., just a few centimeters thick) or of strip Oust a few millimeters thick), it has been proposed to use electromagnetic fields in order to obtain confinement of the molten metal (see, for example, the U.S. Pat. Nos. 4,353,408 and 5,513,692).

Up to now, the systems referred to above have not yielded satisfactory results or have proven too costly to implement. For this reason, the present invention proposes to overcome the drawbacks discussed above presented by the known systems of the state of the art.

SUMMARY OF THE INVENTION

A primary purpose of the present invention is to overcome the problems referred to above by providing a method of continuous casting presenting high efficiency, productivity and reliability.

One aim of the present invention is to improve the surface quality of continuously cast products, combining this improvement with an increase in the casting speed to obtain a consequent increase in productivity.

A further purpose of the present invention is to protect the triple point from direct contact with the liquid metal, preventing cooling of the metal in that area.

A further purpose of the present invention is to reduce the surface wear of the refractory material with which the tank or duct upstream of the crystallizer is lined. These purposes are achieved by a device for the continuous casting of molten materials which comprises a first duct, designed to receive molten material, set in a substantially vertical position, a second duct designed to cool the molten material, set in a position lower than that of the said first duct, the said first and second ducts being axially aligned and connected operatively to define a channel designed to enable passage of said molten material, means of injection of the molten material into said channel, and electromagnetic means arranged around at least one stretch of said channel and coaxially thereto and designed to generate magnetic forces operating on said molten material, the said device being characterized in that the said electromagnetic means are made up of a plurality of coils of electrically conductive material and a ferromagnetic core, which can be electrically supplied and are designed to produce a magnetic flux in a direction longitudinal to the channel itself, producing a set of forces acting on said molten material directed orthogonally to the direction of said magnetic flux to keep the outer surface of said molten material detached from the walls of said channel for a substantial stretch of its length.

Thanks to this arrangement, the productivity of the machine increases considerably, producing a more homogeneous cast product having high surface finish, with a consequent reduction in production costs as compared to known continuous-casting devices of the past.

According to a further aspect of the invention, a method is envisaged for continuous casting of molten materials, in particular of metallic bodies such as blooms, slabs, billets, and the like, which, comprises the following steps:

a) continuous pouring of the molten material into a funnel by means of a discharging device until a level corresponding to the covering of the said discharging device is reached;

b) formation of a protective layer of dross on the top surface of the molten material;

c) excitation, with alternating current, of a plurality of electromagnetic coils, generating a longitudinal magnetic flux inside the duct of the funnel made of refractory material containing the molten material;

d) detachment of the external surface of the molten material from the inner wall of said duct so as to form a free space on the entire perimeter of the molten material;

e) advance of the molten material along the duct and in the direction of a second duct of the crystallizer, keeping the thickness of said free space constant along the entire perimeter of the molten material;

f) start of the process of solidification of the molten material just below the area of joining between the funnel and crystallizer equipped with a forced cooling system, with start of formation of a solid superficial layer of the cast material;

g) continuation of solidification of the material during advance of the piece inside the duct of said crystallizer; and h) extraction of the solidified material from the casting device by appropriate means of extraction.

Thanks to this method, any phenomena of sticking of the cast material to the walls of the duct or crystallizer are prevented, and protection of the surface of the refractory material lining the inside of duct or tank is guaranteed.

BRIEF DESCRIPTION OF THE FIGURES

Further characteristics and advantages of the invention will emerge more clearly in the light of the detailed description of a preferred, but not exclusive, embodiment of a device for the continuous casting of molten materials, for the production of blooms, slabs, billets, and the like, illustrated to provide a non-limiting example with the aid of the annexed tables of drawings in which.

DETAILED DESCRIPTION OF PREFERRED EMBODIMENTS OF THE INVENTION

Figure 1:
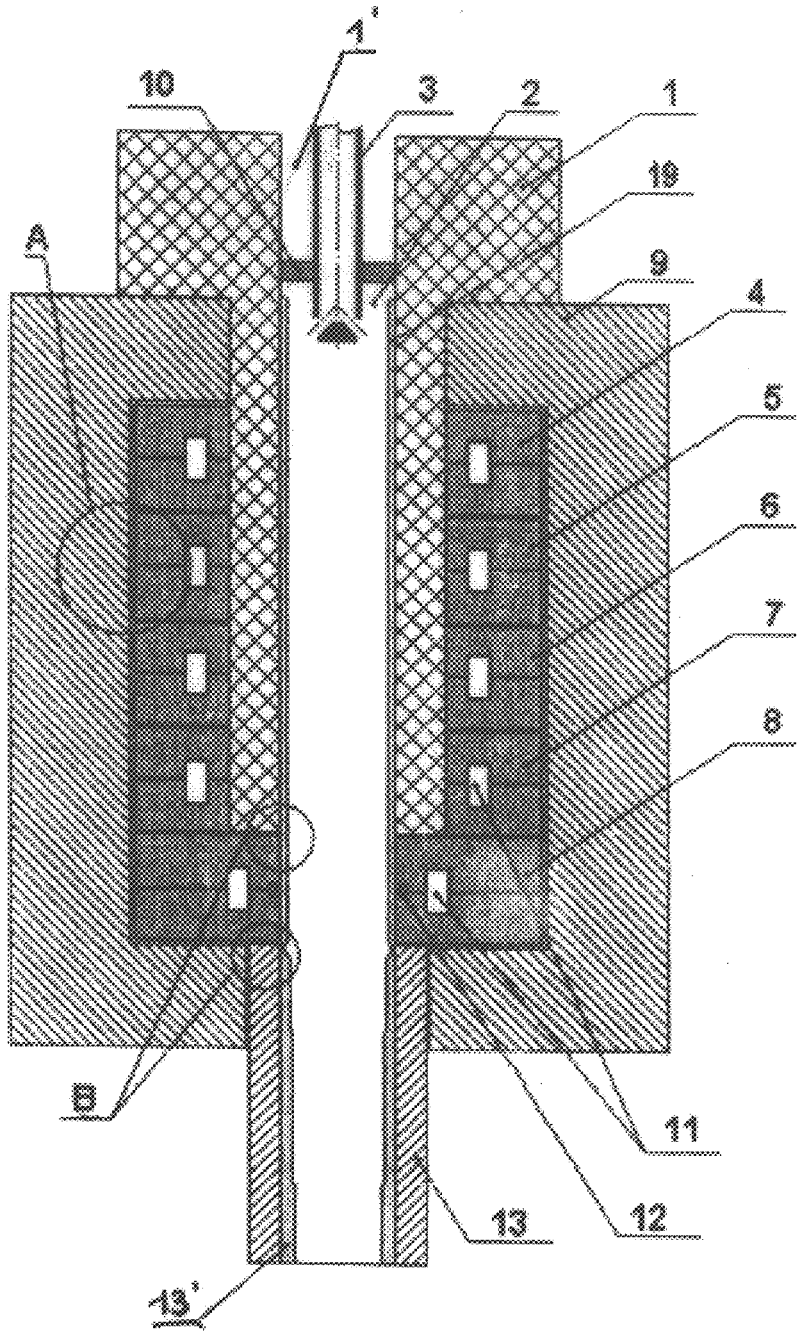
FIG. 1 is a sectional view of the continuous-casting device according to the invention.
Figure 2:
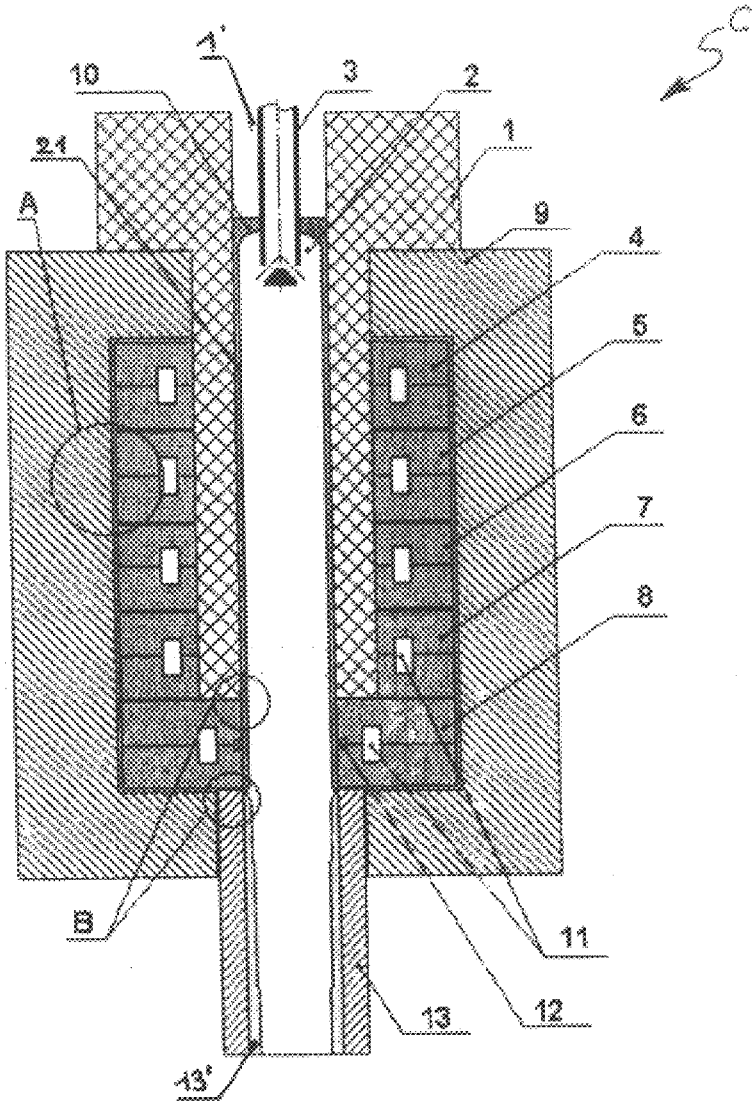
FIG. 2 is a sectional view of a second embodiment of the continuous- casting device according to the invention.

With reference to the figures cited, a device for carrying out continuous casting according to the invention, indicated globally by C, comprises a funnel 1 made of refractory material defining inside it a duct 1', in which a feed discharging device 3 is immersed, which conveys the metal or other material 2 in the molten state from the tundish into the funnel 1. The dimensions of the duct 1' of said funnel are appropriately selected according to the dimensions of the section of the material to be made by casting.

A device, which is in itself known and not illustrated in the figures, for regulating the level of the metal inside the duct 1' of the funnel 1 ensures that the level always remains at an optimal height for operation of the casting device. A layer of dross 10 forms a plug which prevents contact of the metal in the top part of the duct 1' with the environmental air and thus prevents oxidation of the metal 2 itself. The bottom part of the funnel 1 is surrounded by an electromagnetic device which comprises a plurality of magnetic coils 4, 5, 6, 7, 8, made of a material with high electrical and thermal conductivity, in the form of a ring, and a magnetic core 9. The number of coils is appropriately selected according to the height of the column of molten metal which is to be maintained in operation above the triple point, that is, the point of contact between the bottom part of the duct 1' of the funnel 1 and the top part of another duct 13' made inside the crystallizer 13, and coaxial with the first duct 1'. The respective ducts 1' and 13' of the funnel 1 and of the crystallizer 13 define a channel through which the cast pieces are guided in a continuous way.

Each of the said coils is provided with a cooling system 11, advantageously a water cooling system, but it is also possible to use other cooling systems of a known type.

The funnel 1 and the crystallizer 13 are separated from one another by one 8 of the said coils, which is set coaxially to both of the said elements, the said coil having the shape and dimensions of its internal section corresponding to those of the funnel 1 and hence of the section of the piece to be cast. The internal surfaces of this coils are coated with a deposited protective layer 14, of appropriate thickness, to insulate the coil both electrically and thermally from the element produced by casting. This layer of insulating coating may be deposited for example by laser-welding techniques.

The coil 8 advantageously includes a lubrication system comprising ports 12 fed with a lubricating material to favour sliding of the cast product within the duct, according to the type of casting to be made.

This coil 8, in its bottom part, is in contact with a metal crystallizer 13, for example made of copper, which is cooled by means of a forced-circulation water cooling system of its own, not illustrated in the figures.

At the joint between the winding 8 and the crystallizer 13, and between the windings themselves are set electrically insulating inserts 16.

Figure 3:
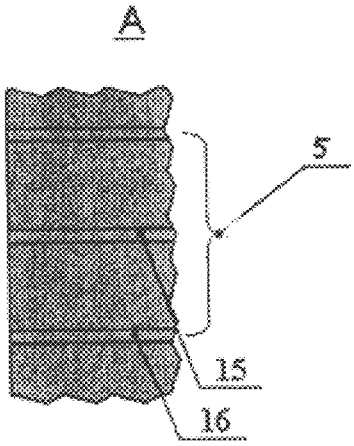
FIG. 3 is an enlargement of a detail of the device of FIG. 1.
Figure 4:
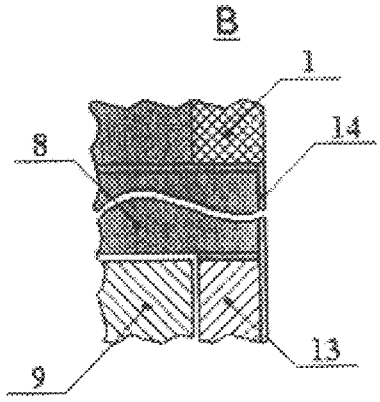
FIG. 4 is an enlargement of another detail of the device of the FIG. 1.

Each coil consists of two turns insulated from one another by a layer of insulating material 15. The details of the areas of contact of the coil are represented in FIGS. 3 and 4.

Figure 5:
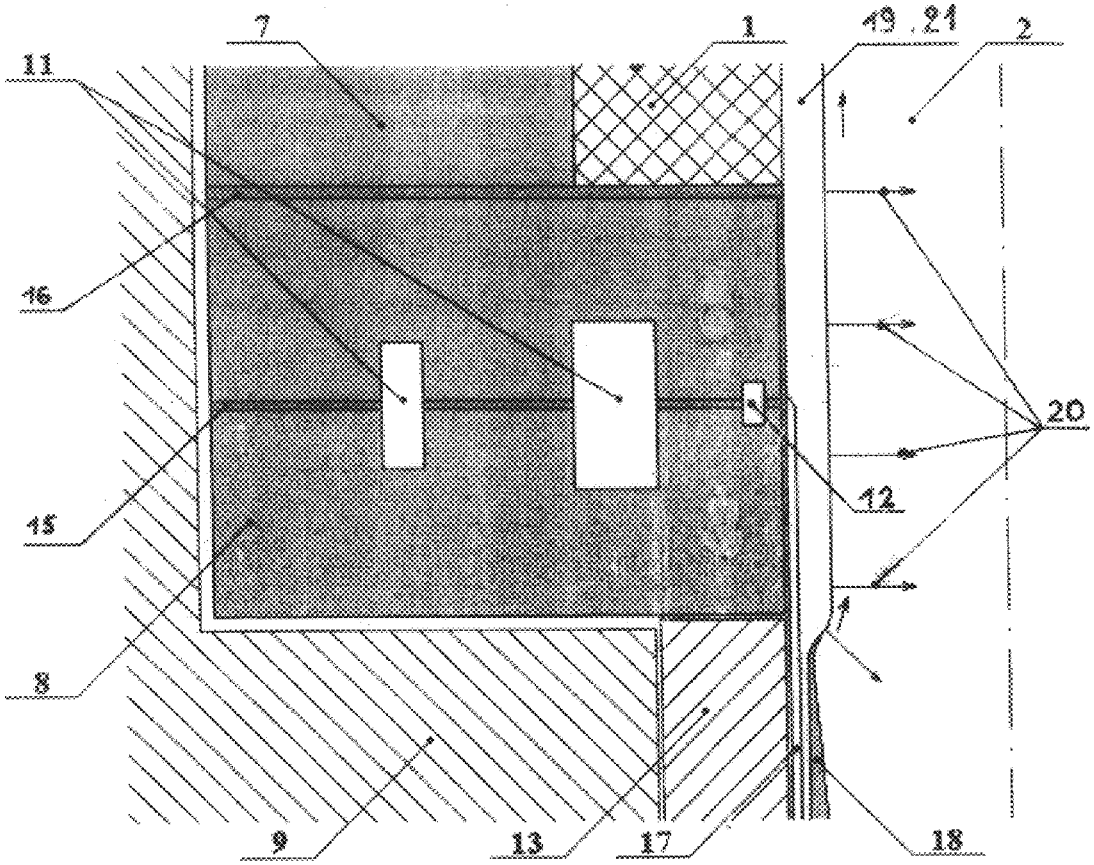
FIG. 5 is a sectional view of a detail of the device according to the invention.

In conformance with the invention, it is possible to avoid the use of lubricant in the area corresponding to the surface of contact between the external surface of the cast product and the internal walls of the ducts 1' and 13'. For this purpose supplying the coils with alternating current is envisaged to induce, inside the funnel 1, in the longitudinal direction, a magnetic field and parasitic currents in the liquid metal 2, which are directed orthogonally to the axis of the ducts 1' and 13'. The useful frequency of the alternating current is comprised within an interval ranging between 50 and 25,000 Hz and the intensity is comprised within an interval ranging between 100 and 10,000 A. The parameters of the current are appropriately defined according to the type of cast metal and to the maximum limit of overheating allowed in the casting process. The electromagnetic forces which arise in the liquid metal have a direction orthogonal to the line of magnetic induction and also perpendicular to the parasitic currents. Consequently, the electromagnetic forces are also perpendicular to the internal surfaces of the coils and are indicated with the reference number 20 in FIG. 5.

The electromagnetic pressure is such as to repel the liquid metal along the entire internal surface of the casting device starting from the level of the top free surface of the liquid as far as the area of the triple point and a circular free space 19 or 21 around the piece 2 of cast metal. Consequently, the electromagnetic pressure also promotes and maintains detachment of the solidifying "skin" 18 from the walls of the duct 13' of the crystallizer 13, thus reducing friction between the latter and the cast piece.

The thickness of the cavity 19 or 21 around the cast piece may be regulated by varying the current in the turns of the coils 4 to 8. For this purpose, each coil has an independent electrical supply and is connected in parallel with a capacitor, so creating an oscillating circuit. The parameters of inductance of the turns and capacitance of the capacitor are selected so that the oscillating RLC circuit works close to the resonance value of the current. As the molten metal approaches the turn, the current increases by 7 to 10 times, and consequently the electromagnetic forces increase, thus preventing contact between the turn and the liquid metal 2.

In fact, in continuous-casting systems, generally the molten metal 2 fed by the discharging device 3 does not have a regular motion, and this causes lack of uniformity of temperature and the possibility of drawing of non-metallic inclusions, such as dross or fragments of refractory material, within the bath and as far as the start-of-solidification area.

The molten metal, with a flow rendered uniform by the fact that the turbulence of immission remains confined at a distance from the crystallizer 13, proceeds down the funnel, until it reaches the boundary area with the crystallizer 13, where it cools, and the solidified "skin" 18 of the piece of casting starts forming in a homogeneous way. In this way, the risk is avoided of the "skin" 18, in some point of the surface of the cast piece, having a non-uniform thickness that gives rise to cracks, which, during the casting process, may open on account of the thermomechanical stresses and thus cause the molten metal to leak out.

In addition, the fact that there is a cavity 21 which surrounds the liquid metal also upstream of the triple point prevents the whole cast piece 2 from coming into contact with the internal walls of the duct and consequently prevents its solidification in contact with the refractory material of the funnel 1 and with that of the induction coil 8.

At the level of the triple point, it may be advisable to inject a lubricant into the said cavity, which may advantageously contain ferromagnetic particles that help to concentrate the said electromagnetic forces, so enabling the formation of a free space 19 or 21 that is larger and more stable. In this way, a superficial film 17 is formed, which covers the cast piece 2, beginning from the portion where its solidification starts.

In the channel made up of the duct 1' of the funnel 1 and of the duct 13' of the crystallizer 13, casting is started by initially closing the duct in the bottom part with a dummy bar, after which the duct is filled with molten metal by means of a discharging device 3. After activation of the system of windings from 4 to 8, the liquid metal is detached from the wall of the duct under the action of the electromagnetic forces 20.

During normal full operating conditions, the molten metal 2 is protected from oxidation according to three different procedures.

The first solution consists in forming a floating plug of covering powders and dross 10 in the top part, and a layer of dross in the free space around the surface of the cast piece.

The second solution consists in creating a plug of dross 10 which closes the top part of the duct that is full of molten metal, to which the formation of the free space 19 around the lateral surface of the cast piece 2 is associated, the said space being filled by an inert gas, for example argon.

The third solution, instead, envisages that both the plug 10 for closing the cast metal on top and the free space 19 around the cast piece should be filled with inert gas.

In these latter two cases, the casting device is provided with a series of ducts (not illustrated in the figures), the outlets of which are arranged along the entire internal space of the device in order to allow the inert gas to flow in the most appropriate way.

The process according to the present invention also envisages the possibility of introducing lubricant at the height of the said triple point, with the purpose of favouring sliding of the skin being formed against the walls of the duct 13' of the crystallizer 13, should this prove necessary.

Should the crystallizer 13, in its operation as element for cooling the cast bar, contemplate the possibility of moving with oscillations in a vertical direction, there is the risk that the position of the triple point will thus vary. In this case, it is possible to stabilize the position of the triple point by varying the current in the windings, since by so doing the length of the duct changes according to the oscillation, so that the bottom point of the duct 1' does not change its position in space.

Figure 6:
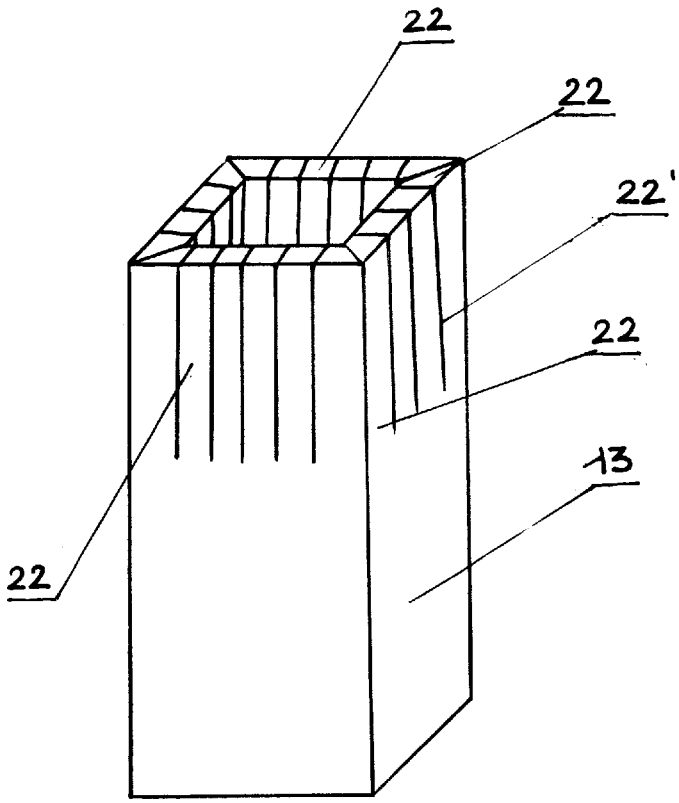
FIG. 6 is a perspective view of a detail of the device according to the invention in a variant embodiment.
Figure 7:
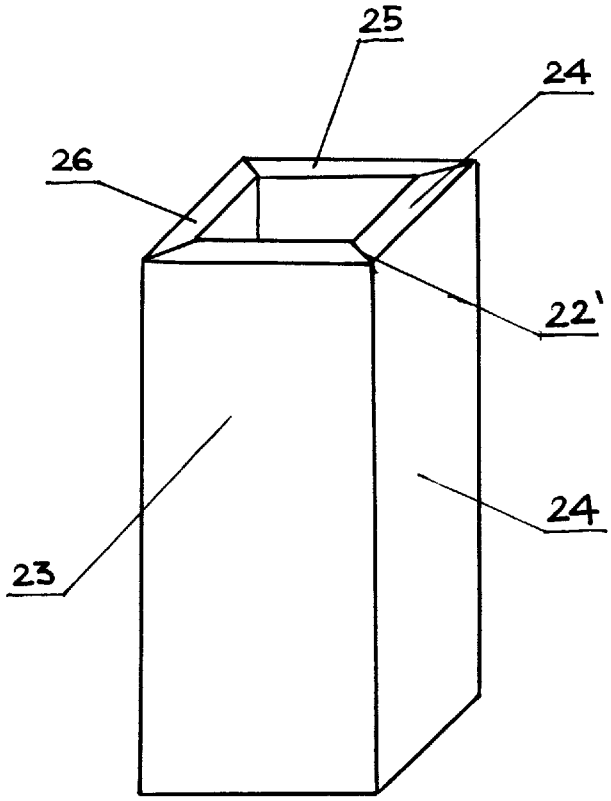
FIG. 7 is a perspective view of a detail of the device according to the invention in a further variant embodiment.

To facilitate penetration of the electromagnetic forces within the crystallizer 13 and to enable start of solidification of the liquid metal below the joining point between the said crystallizer 13 and the area above it made up of coils alone, or else of coils and refractory material, the crystallizer 13 is appropriately made up of a plurality of vertical segments 22 which are electrically insulated from one another. As an alternative, the said vertical segments may advantageously simply be provided with incisions in the top portion of the crystallizer that have a predetermined length L of between 50 and 100 mm from the top of the crystallizer, as represented in FIG. 6. Into the incisions 22', an electrically insulating material is inserted.

In a further advantageous variant embodiment of the crystallizer 13, the latter is made up of four plates 23–26 joined together along their respective longitudinal edges. Also in this case, the plates are electrically insulated from one another in the longitudinal direction in the area of mutual contact. In this way, a simplified structure is obtained, as well as a consequent reduction in fabrication costs.

What is claimed is:

1. Device for the continuous casting of molten materials, comprising a funnel made of refractory material defining a first duct adapted to receive molten material, and disposed substantially in a vertical position, a crystallizer defining a second duct adapted to cool the molten material and positioned below the funnel, said first and second ducts being axially aligned and operatively connected so as to define a channel for the flow of the molten material, means for injecting the molten material into said channel, electromagnetic means coaxially surrounding an axial portion of said channel for generating magnetic forces operating on said molten material, said electromagnetic means comprising a ferromagnetic core and a plurality of coils of electrically conductive material, of which at least two or more first coils externally surround the entire first duct and of which at least one second coil is positioned between a lower extremity of said funnel and an upper extremity of said crystallizer, the at least one second coil being provided with an internal wall facing towards the inside of said channel and defining a portion of it and separating the funnel from being in contact with the crystallizer, said plurality of coils being adapted to be fed electrically to produce a magnetic flux in the longitudinal direction of the channel itself, thereby producing a set of forces acting on said molten material which are directed orthogonally with respect to the direction of said magnetic flux, in order to maintain detachment of an outer surface of said molten material from the walls of said channel for a portion of its length comprising the lower part of the funnel and the crystallizer.

2. The device according to claim 1, wherein the said electromagnetic means are supplied with alternating current at a frequency of between 50 and 25,000 Hz and at an intensity of between 100 and 10,000 A.

3. The device according to claim 1, wherein said at least one second coil is provided with ports designed to introduce lubricant into said channel.

4. The device according to claim 1, wherein said at least two first coils are provided with a plurality of channels adapted to convey a coolant fluid.

5. The device according to claim 4, wherein said at least one second coil is provided, on its surface in contact with the liquid metal, with an electrically insulating coating.

6. The device according to claim 5, wherein each coil is connected in parallel to capacitors with which it forms an electrical resonance circuit, and in that each coil can be electrically activated separately from the other coils or in combination with them.

7. The device according to claim 6, wherein a peripheral wall of said second duct consists of a plurality of vertical segments that are electrically insulated from one another.

8. The device according to claim 6, wherein the peripheral wall of said second duct is provided with incisions in its top portion which have a predetermined axial length L.

9. The device according to claim 6, wherein the peripheral wall of said second duct comprises four plates connected together along respective longitudinal edges.

10. A method for continuous casting of metallic products using a continuous casting device comprising a funnel and a crystallizer positioned below the funnel, which define a channel for passage of a molten material, comprising the following steps:

a) providing first coils to externally surround the funnel;

b) providing at least one second coil positioned between the lower extremity of the funnel and the upper extremity of the crystallizer;

c) pouring the molten material continuously into the funnel by means of injection until a level covering an outlet mouth of the injection means is reached;

d) forming a protective layer of dross on the top surface of the molten material;

e) feeding the plurality of electromagnetic coils with alternating current, thus generating a longitudinal magnetic flux inside a portion of the channel filled with molten material in correspondence with the funnel and of a triple point junction thereby detaching an outer surface of the molten material from the internal wall of said channel to form a size of free peripheral space at the triple point and along the entire perimeter of the molten material;

f) varying selectively the current in the coils for producing vertical oscillations on the crystallizer to maintain the size of the free peripheral space constant at the triple point junction and along the entire perimeter of the molten material during advancement of the molten material along the channel during casting operation and to maintain constant the relative position of the triple point with respect to the metallic product;

g) injecting lubricant along the walls of the channel in order to favor sliding of the solidifying skin; and h) extracting the solidified material from the continuous casting device after passing through the crystallizer.

11. The process according to claim 10, wherein said protective layer on the top surface of the molten material is formed with dross or inert gas.

12. The process according to claim 11, wherein the free peripheral space is filled with an inert gas.

13. The process according to claim 11, wherein the free peripheral space is filled with dross.

* * * * *